US006742435B2

(12) United States Patent
Staiert et al.

(10) Patent No.: US 6,742,435 B2
(45) Date of Patent: Jun. 1, 2004

(54) HIGH-MOBILITY ARTILLERY CANNON SYSTEM

(75) Inventors: Richard W. Staiert, Coon Rapids, MN (US); Robert B. Stratton, Andover, MN (US)

(73) Assignee: United Defense, L.P., Arlington, VA (US)

( * ) Notice: Subject to any disclaimer, the term of this patent is extended or adjusted under 35 U.S.C. 154(b) by 0 days.

(21) Appl. No.: 09/834,821

(22) Filed: Apr. 13, 2001

(65) Prior Publication Data

US 2002/0050208 A1 May 2, 2002

Related U.S. Application Data

(60) Provisional application No. 60/243,709, filed on Oct. 27, 2000, now abandoned.

(51) Int. Cl.[7] ..... F41A 23/26

(52) U.S. Cl. ..... 89/40.13; 89/40.02; 89/40.04; 89/40.07; 89/40.08; 89/40.09; 89/40.12

(58) Field of Search ..... 89/40.13, 40.14, 89/40.01, 40.04, 40.16, 37.05, 40.07, 40.02, 37.13, 40.08, 40.09, 40.11, 40.12, 40.15

(56) References Cited

U.S. PATENT DOCUMENTS

| | | | | |
|---|---|---|---|---|
| 911,810 A | * | 2/1909 | Dreger | |
| 1,396,598 A | * | 11/1921 | Schneider | |
| 2,339,334 A | * | 1/1944 | Heaslet | |
| 2,549,835 A | | 4/1951 | McCann et al. | |
| 3,366,009 A | | 1/1968 | Aldrin | |
| 4,729,279 A | * | 3/1988 | Collanus et al. | 89/40.13 |
| 5,461,961 A | | 10/1995 | Baus et al. | 89/40.03 |
| 5,604,327 A | * | 2/1997 | Skoglund et al. | 89/46 |
| 6,024,007 A | | 2/2000 | Searle et al. | 89/43.01 |
| 6,178,866 B1 | | 1/2001 | Searle et al. | 89/37.08 |
| 6,457,396 B1 | * | 10/2002 | Bean et al. | 89/40.04 |

FOREIGN PATENT DOCUMENTS

| | | |
|---|---|---|
| EP | 179 753 | * 4/1986 |
| FR | 2 663 727 | * 12/1991 |

OTHER PUBLICATIONS

British Defence Equipment Catalogue; cover page and p. 545; Ministry of Defence; 1984–1985.*

Jane's Weapon Systems; pp. iv, v, 358, 363; Pretty and Archer; 1970–1971.*

Military Analysis Network, C–130 Hercules—Military Aircraft. Internet pages. pp. 1–15 no date.

Military Analysis Network, M1086 LWB Truck. Internet pages. pp. 1–5 no date.

Military Analysis Network, XM777 Lightweight 155 mm howitzer (LW155). Internet pages. pp. 1–8 no date.

Lightweight 155mm (LW155) System Performance Specification. pp. 1–51 no date.

Rendall, *Jane's Aircraft Recognition Guide*, Harper–Collins, Nov. 1995.

AETC Training Support Squadron, *C–130 E/H Handbook*, On–the–Job Maintenance Training Guide, Hill AFB, Utah; Oct. 15, 1995.

* cited by examiner

*Primary Examiner*—Stephen M. Johnson
(74) *Attorney, Agent, or Firm*—Patterson, Thuente, Skaar & Christensen, P.A.

(57) ABSTRACT

A high-mobility artillery cannon system transportable with the cargo envelop of a transport aircraft, includes a lightweight field howitzer, a medium tactical vehicle, and a bed disposable on the vehicle, the bed for receiving and supporting the howitzer such that the vehicle with the howitzer disposed on the bed is receivable within an envelop having substantially the dimensions of the cargo envelop defined within the C-130 type transport aircraft. A method of configuring a cannon system for transport the C-130 type transport aircraft is included.

19 Claims, 16 Drawing Sheets

10
76
12
80
60
60
52
58b
58a
56b
56a
54
54
14
40
44
42

10
114
116
60
80
58a
12
14
40
44
42
54
56a

HIGH-MOBILITY ARTILLERY CANNON SYSTEM

RELATED APPLICATION

The present application claims the benefit of U.S. Provisional Application No. 60/243,709 filed Oct. 27, 2000, now abandoned, which is incorporated herein in its entirety by reference.

TECHNICAL FIELD

The present invention relates to artillery. More particularly, the present invention relates to an artillery piece that is readily disposable on a transport vehicle, the transport vehicle with artillery piece being receivable within the cargo envelope of a known transport type aircraft.

BACKGROUND OF THE INVENTION

There is a need for highly mobile combat units. The units should include a fleet of vehicles where each of the individual combat vehicles, the crews to man such vehicles, and sufficient fuel and ammunition should be transportable on a single transport aircraft. Specifically, the aircraft to provide the transportation is the C-130 type aircraft. Further, once the individual combat vehicle is in a theater of operations, the individual combat vehicle should have the same level of mobility as all other vehicles in the unit to ensure that the unit is able to move as a whole. While certain vehicles and relatively small weapons meet the aforementioned requirement, larger fire support systems typically have a towing vehicle and a towed cannon. With such arrangement, both the towing vehicle and the towed cannon are not disposable as a unit within the cargo envelope of a single C-130 aircraft. Further, the fact that the cannon must be towed limits the mobility of the cannon relative to other non-towed weapons suitable for use with the combat unit which are capable of significantly greater overland speeds.

There is a need then to provide a C-130 transportable high mobility cannon system including a transport vehicle and artillery cannon combination that is capable of being transported by a single C-130 aircraft in a single sortie. The cannon system should be immediately deployable upon discharge from the aircraft and have the same degree of mobility as other vehicles in the combat unit once deposited in a theater of operations by the C-130 type aircraft. There is further a need to maximize the currently existing equipment content of such a system in order to maintain low cost and to provide a low technical and schedule risk approach that will quickly provide a suitable high-mobility artillery cannon system.

SUMMARY OF THE INVENTION

The high-mobility artillery cannon system of the present invention substantially meets the aforementioned needs. The system uses an existing light weight howitzer designated XM777 as the cannon component of the system. Additionally, the system utilizes an existing vehicle designated the FMTV M1086A1 long wheelbase chassis truck that is currently in production. By using an existing cannon and an existing vehicle, overall cost of the system is greatly reduced, the technical risk of the system is minimized and a schedule for making the system available to users is also greatly minimized. In order to form the system of the present invention, both the cannon and the vehicle undergo certain modifications as noted below.

The major modification to the vehicle is the installation of the tilt bed, forming the rear portion of the vehicle bed. A stationary bed is preferably disposed forward of the tilt bed. The modified vehicle is used to transport the cannon, crew, and ammunition for enhanced tactical mobility. Further, a transport configuration with the cannon mounted on the vehicle is disposable within the weight and envelope limits established for transport by C-130 type aircraft.

In practice, the vehicle may be maneuvered into a position with the tube of the cannon oriented generally in the direction of desired firing while the cannon is still disposed on the tilt bed. The tilt bed may then be operated to place the cannon on the ground immediately behind the truck with little or no further manhandling of the cannon required to position it for firing. The tilt bed is then operated to position the rear margin of the tilt bed approximate the ground surface and the cannon is traversed down the tilt bed to a position on the ground. All that is necessary then is to deploy the cannon spades, and to transverse and elevate the gun to the final lay position. When the vehicle is disposed rearward of the cannon, ammunition stored on the stationary portion of the bed may be transferred by gravity assist down the tilt bed and made available to personnel that are employing the cannon.

In a preferred embodiment, a relatively small cab is provided on the stationary portion of the bed in order to house additional members of the cannon crew and equipment that they may require.

In a first embodiment, the cannon is disposed on the tilt bed with the muzzle of the cannon facing forward. In order to minimize the height dimension of the system of the present invention for aircraft transport, including both the vehicle and the cannon, the tilt bed is traversed slightly rearward on the vehicle chassis and tilted slightly downward. In this disposition, the muzzle of the cannon is disposed rearward of the cab of the vehicle. In a further preferred embodiment, the cannon is mounted on the tilt bed with the muzzle of the cannon facing rearward. When disposed within the cargo volume of the C-130 type aircraft, the muzzle of the cannon projects outward from the aircraft in the space defined above the ramp of the C-130 aircraft.

Modifications to the cannon include the installation of at least one "quick hitch". The quick hitch is engageable with a hitch that is disposed on a powered track. The power track is disposed generally in the centerline of the tilt bed. The track hitch is powered to move along the longitudinal axis of the tilt bed so as to draw the cannon up the tilt bed when loading and to lower the cannon down the tilt bed when unloading.

When the high-mobility artillery cannon system of the present invention is delivered by a C-130 type aircraft to an operational area, the system emerges from the C-130 cargo area ready for operational employment. The entire crew is transported in the C-130 aircraft and the system with the cannon mounted on the vehicle is fully equipped with all the equipment necessary and a sufficient number of ammunition rounds to immediately employ the cannon. The vehicle contains storage compartments for the equipment and ammunition conveyors to increase crew capability, reduce timelines for employment of the cannon, and minimize crew fatigue involved in laying the cannon and conveying ammunition to the cannon.

The present invention is a high-mobility artillery cannon system transportable with the cargo envelop of a transport aircraft, and includes a lightweight field howitzer, a medium tactical vehicle, and a bed disposable on the vehicle, the bed for receiving and supporting the howitzer such that the vehicle with the howitzer disposed on the bed is receivable within an envelop having substantially the dimensions of the cargo envelop defined within the C-130 type transport aircraft. The present invention is further a method of configuring a cannon system for transport in the C-130 type transport aircraft.

DETAILED DESCRIPTION OF THE DRAWINGS

Figure 1:
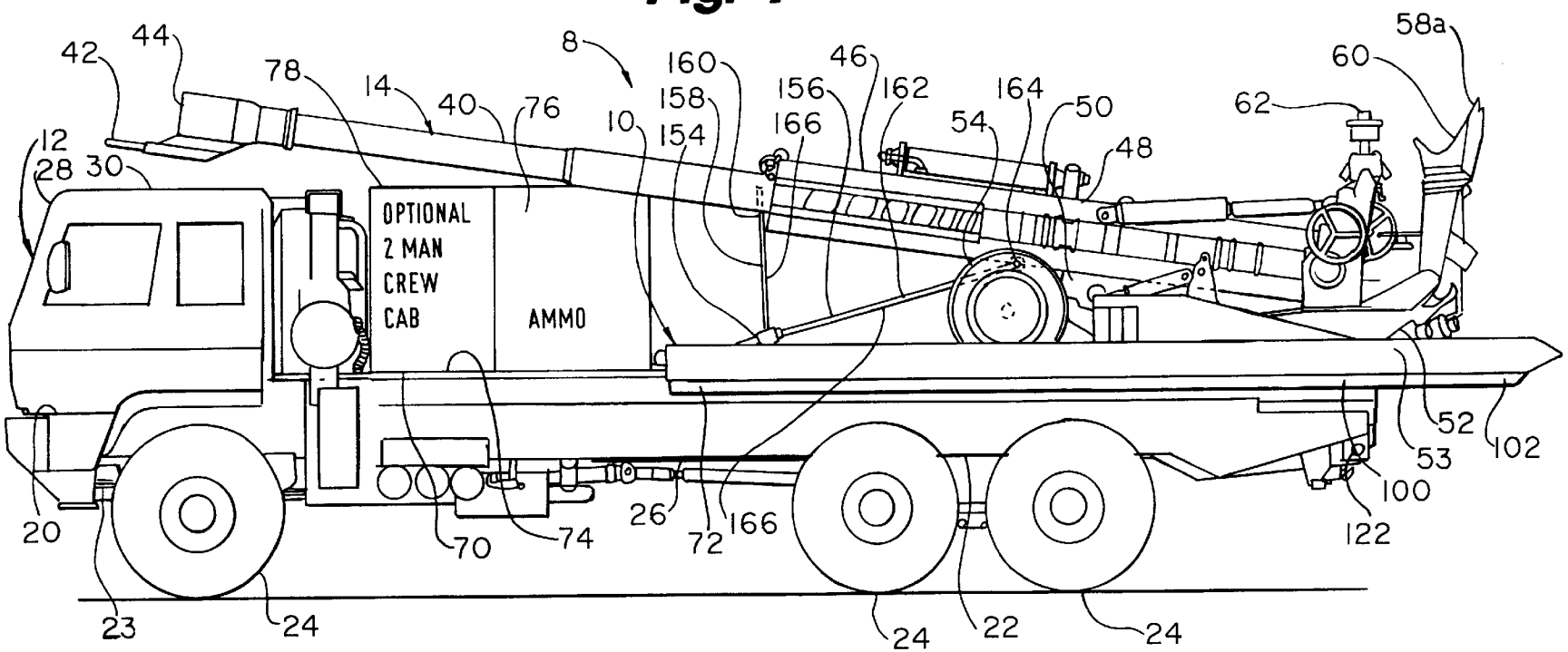
FIG. 1 is a side elevational view of the cannon system of the present invention with the howitzer mounted in the transport at disposition on the vehicle and the vehicle having the optional two man crew cab.

The high-mobility artillery cannon system of the present invention is shown generally at 8 in the figures. The cannon system 8 generally includes a tilt bed system 10 mounted on a vehicle 12, a howitzer 14 being loadable and unloadable from the vehicle 12 by means of the tilt bed system 10. In a first embodiment, depicted in FIGS. 1–6*h*, 8*a* and 8*b*, the preferred vehicle 12 that is a component of the cannon system 8 is designated a M1086A1 5.0 ton LWB (long wheelbase) vehicle. This vehicle 12 is one of the "Family of Medium Tactical Vehicles" (FMTV) that is currently being provided to U.S. and allied armed forces. The baseline vehicle 12 has a cargo handling crane disposed proximate the rear margin thereof. For use as a component of the cannon system 8 of the present invention, the cargo handling crane is removed from the vehicle 12. As currently being procured, the vehicle 12 is manufactured by Stewart & Stevenson of Sealy, Tex.

Detailed specifications of the above noted vehicle 12 are well known to those skilled in the art. Generally, the vehicle 12 has a chassis 20 that includes a rear wheel suspension 22 and a front wheel suspension 23 mounted to a frame 26. The wheel suspensions 22, 23 each support wheels 24. A cab-over type cab 28 is disposed at the forward end of the vehicle 12. The cab 28 is partially enclosed by the cab roof 30. A fishtail 32 is mounted proximate the rear margin of the frame 26. The fishtail 32 comprises a subframe that, in its normal configuration, supports the aforementioned cargo handling crane disposed at the rear of the vehicle 12. When the vehicle 12 is used as a component of the cannon system 8 of the present invention, the rearmost portion of the fishtail 32, which otherwise underlies and supports the crane, is removed.

The preferred howitzer 14 for use with the cannon system 8 is a light weight howitzer (LWH) designated XM777. The howitzer 14 is a 155 mm howitzer currently being supplied to the U.S. armed forces. The XM777 howitzer 14 is currently manufactured by BAE Systems, a firm located in the United Kingdom. Detailed specifications of the preferred howitzer 14 are well known to those skilled in the art.

Generally, the howitzer 14 includes an elevatable and tranversable tube 40. The tube 40 includes a tow eye 42 mounted proximate the muzzle 44 thereof. The tube 40 is coupled to a recoil mechanism 46 that is disposed proximate the breach 48 of the tube 40. The recoil mechanism 46 and the tube 40 are mounted on a cradle 50. The cradle 50 is elevatably coupled to an undercarriage 52. In addition to supporting the cradle 50, the undercarriage 52 has extendible wheels 54. The wheels 54 may be extended downward when the howitzer 14 is in a towing configuration and may be retracted up along side the cradle 50 when the howitzer 14 is deployed in a tactical mode.

The howitzer 14 is supported in the tactical disposition by a pair of foldable stabilizers 56*a, b*. The stabilizers 56*a, b* extend generally forward of the undercarriage 52 and are displaced relative to the tube 40 at an angle of about 20 degrees. In the transport mode, the foldable stabilizers 56*a, b* are folded rearward alongside the undercarriage 52 immediately rearward of the folded wheels 54.

The howitzer 14 is further supported in the tactical disposition by a pair of extendible trails 58*a*, 58*b*. Each of the extendible trails 58*a*, 58*b* has a large shovel 60 disposed at the distal end thereof. In the tactical disposition, the trails 58*a*, 58*b* are folded rearward and slightly outward from the undercarriage 52. The shovels 60 engage the soil and will dig into the soil responsive to recoil generated by firing the howitzer. In the transport mode, the extendible trails 58*a*, 58*b* are folded upward at the rear of the undercarriage 52, as depicted in FIGS. 1 and 3–6*h*.

Figure 7:
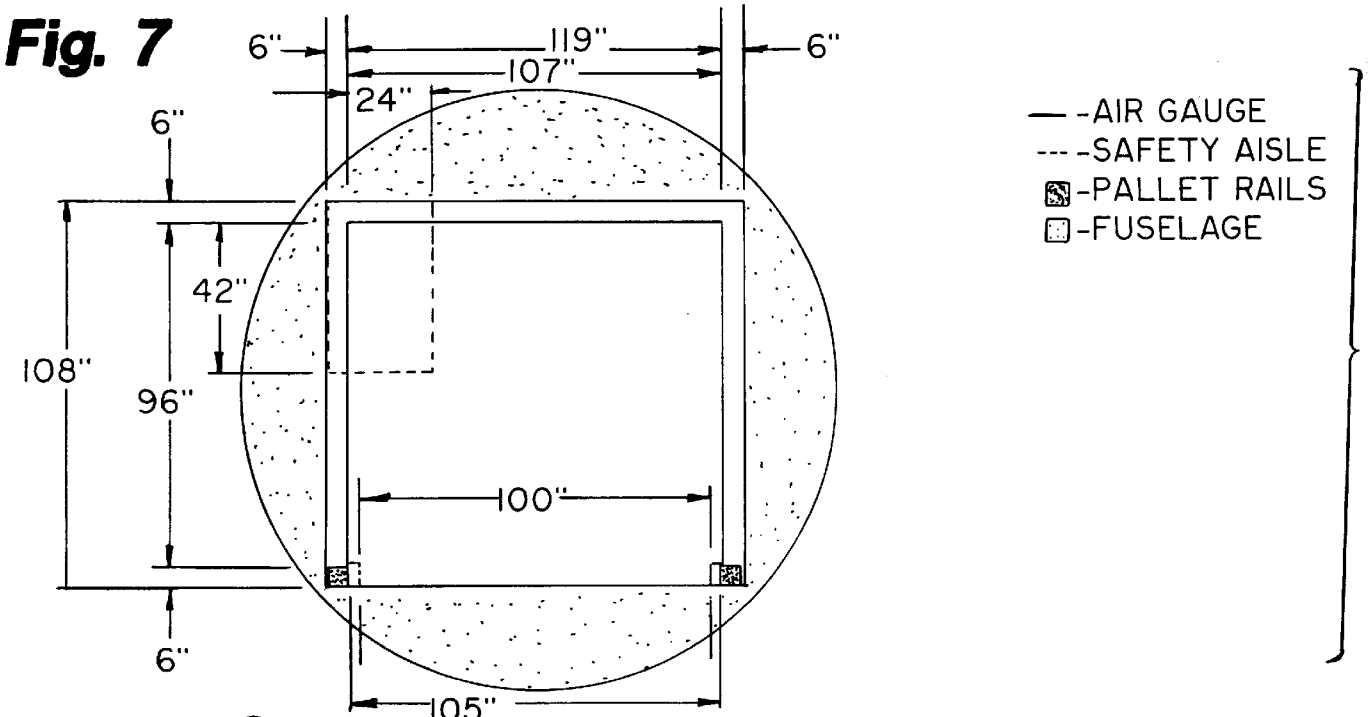
FIG. 7 is a cross sectional view of the cargo area of a C-130 type aircraft.

A pair of optical sight mounts 62 are disposed on the undercarriage 52 displaced slightly left and right of the centerline of the tube 40. Preferably, the sights themselves (not shown) are conveyed in a protected container and manually mounted on the optical sight mounts 62 prior to laying of the howitzer 14. As will be noted later, the upper margin of the optical sight mounts 62 present a challenge for the cannon system 8 in meeting the height limitations of the cargo envelope of the selected transport aircraft, the C-130 as depicted in FIG. 7.

Turning now to the tilt bed system 10 of the cannon system 8, the tilt bed system 10 has two major subcomponents; stationary bed 70 and tilt bed 72.

Figure 2:
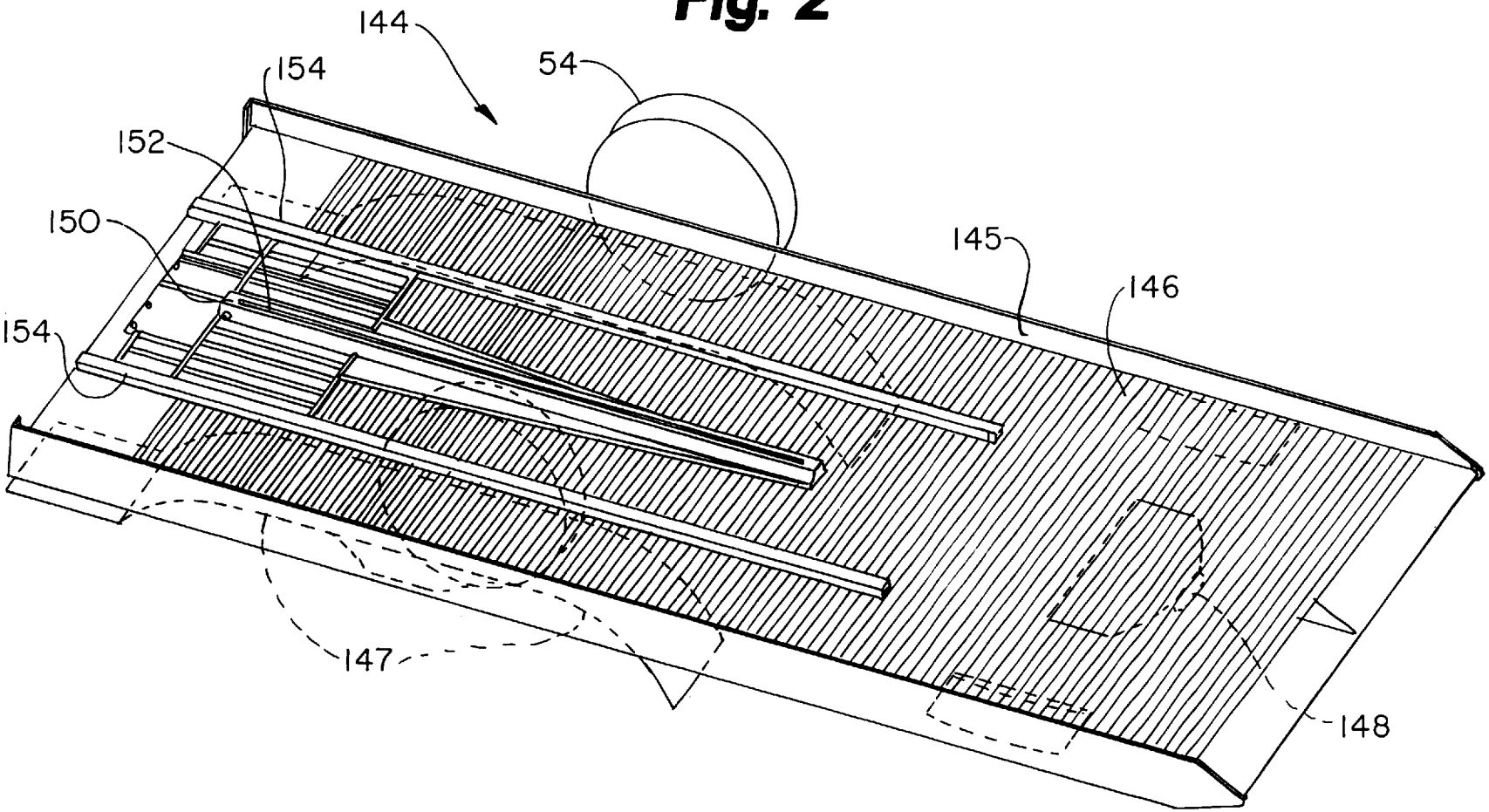
FIG. 2 is a perspective view of the tilt bed with the howitzer wheels depicted as wire drawings in the transport disposition.
Figure 3:
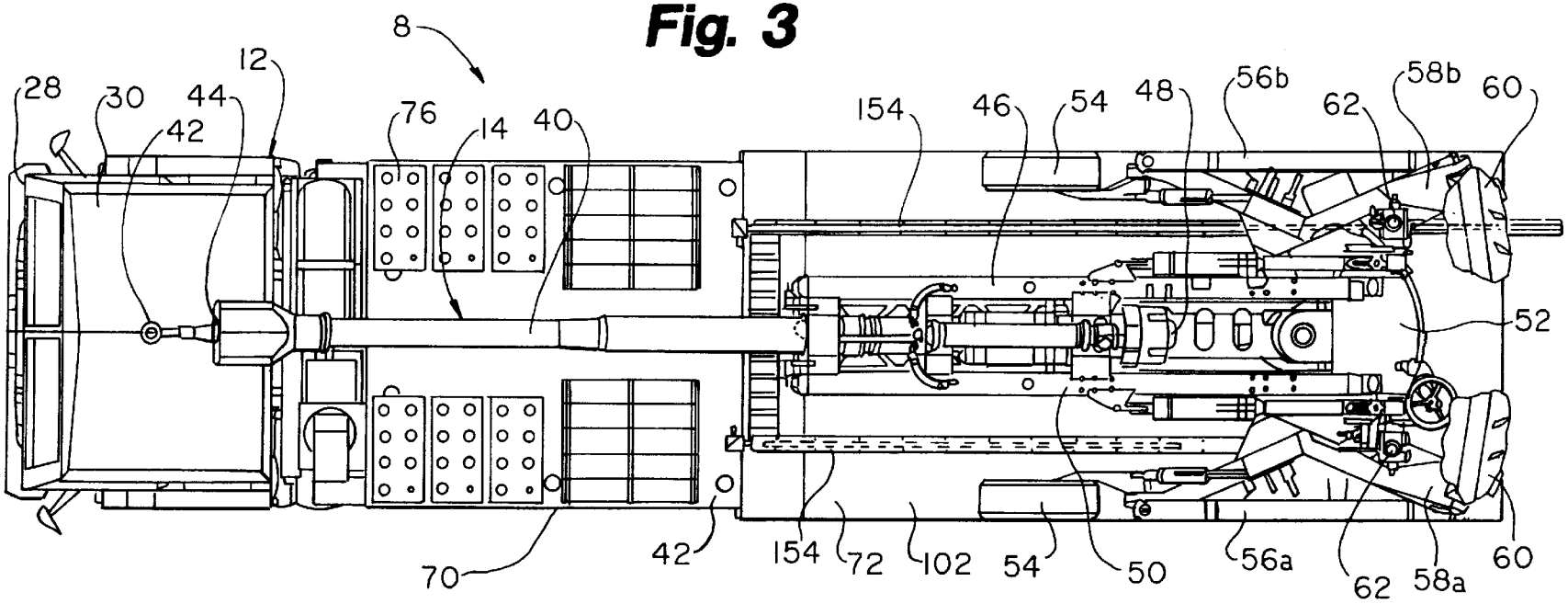
FIG. 3 is a top elevational view of the cannon system with an alternative ammunition storage arrangement on the vehicle and the howitzer in the transport disposition.
Figure 4:
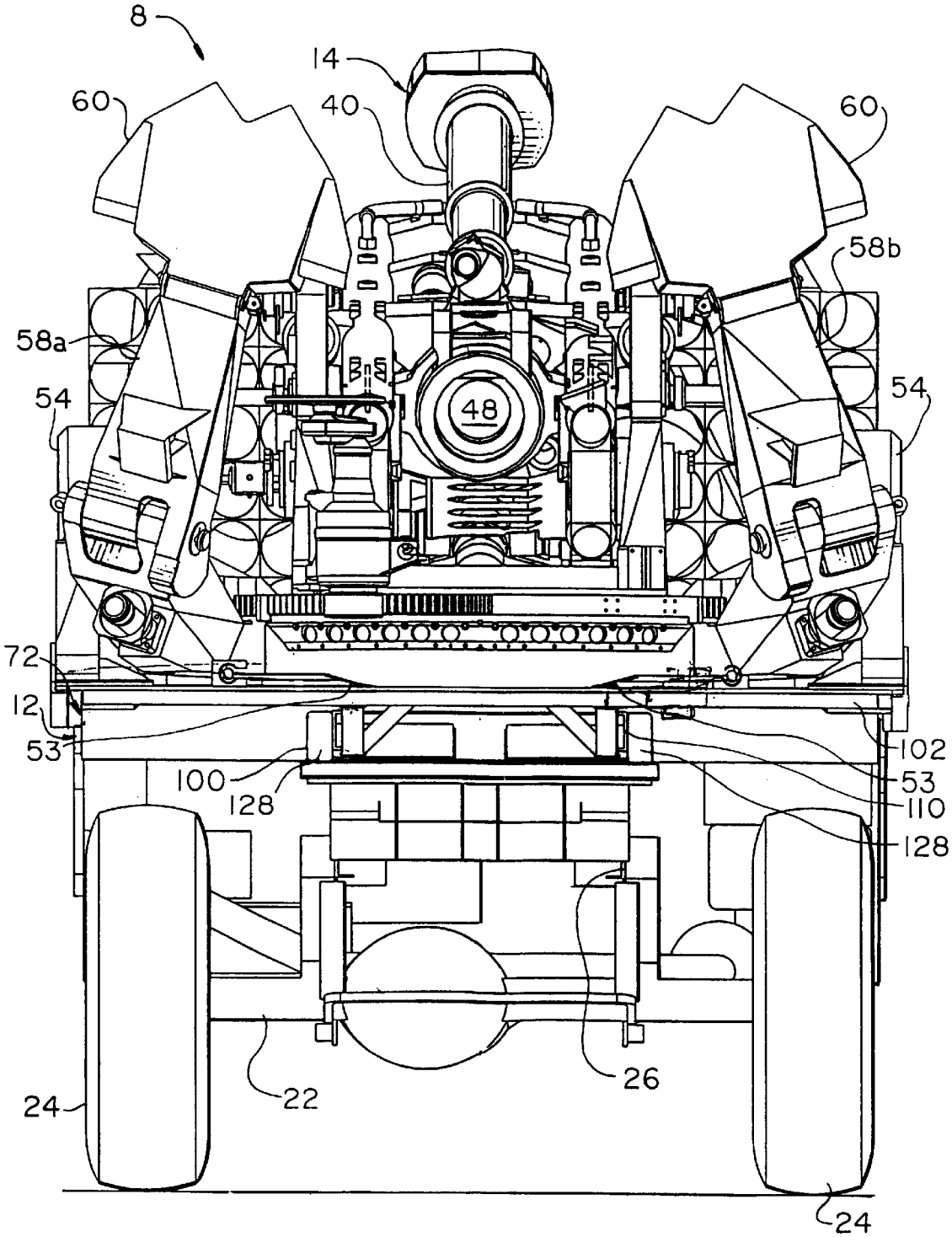
FIG. 4 is a rear elevational view of the cannon system.
Figure 5:
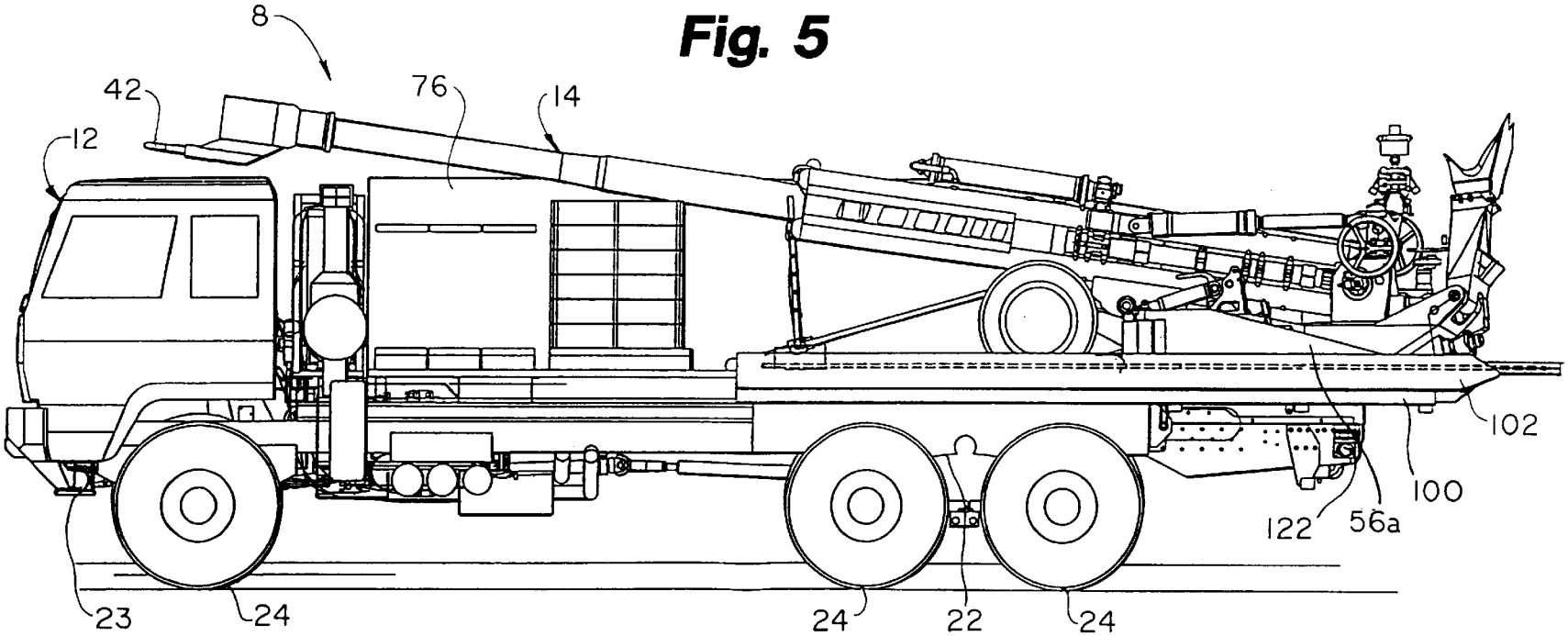
FIG. 5 is a side elevational view of the cannon system as depicted in FIG. 3.

The stationary bed 70 is supported by the frame 26 of the vehicle 12. The stationary bed 70 presents an upward directed support surface 74. A plurality of ammunition storage containers 76 are disposed on a portion of the stationary bed 70. In the embodiment of FIG. 1, the ammunition storage containers 76 are disposed on the forward portion of the stationary bed 70, leaving a space rearward thereof for the storage of other equipment useful in tactically deploying the howitzer 14. In the embodiment of FIG. 2, the ammunition storage containers 76 are disposed rearward on the stationary bed 70. A relatively small optional crew cab 78 is disposed forward of the ammunition storage containers 76.

The howitzer 14 is preferably designed to be served by a minimum crew of five gunners. Three of such individuals may be transported in the cab 28 of the vehicle 12. The remaining two gunners may be transported in the optional crew cab 78. The crew cab 78 preferably has two facing jump seats as well as storage room for the personal effects of the two gunners transported therein. The crew cab 78 may be formed of fiberglass material and may have side entry doors, a rear entry door and windows as desired.

At least one gravity conveyor 80 may be disposed on the support surface 74. The gravity conveyor 80 may be deployed laterally from the stationary bed 70 to feed ammunition to the howitzer 14 when the howitzer 14 is disposed alongside the vehicle 12. See FIGS. 8*a*, 8*b*. Alternatively, the gravity conveyor 80 may be deployed down the tilt bed 72 when the tilt bed 72 is in a tilted disposition to feed ammunition to the howitzer 14 when the howitzer 14 is positioned rearward of the vehicle 12.

The second major component of the tilt bed system 10 is the tilt bed 72. The tilt bed 72 is further comprised of a tilt frame assembly 100 and a tilt bed assembly 102. The tilt frame assembly 100 and tilt bed assembly 102 are best viewed in FIGS. 1–5 and 13–16.

The tilt frame assembly 100 of the tilt bed 72 includes a subrail 104. The subrail 104 is mounted on the upper surface of the frame 26 of the vehicle 12. The subrail 104 includes two opposed C-section sides 106 coupled by a top plate 110. A pair of elongate side gussets 108 may be utilized to couple the subrail 104 to the frame 26 as by welding along the side gussets 108 or the like. The subrail 104 extends substantially the full length of the bed area of the vehicle 12. In a preferred embodiment, the height of the C-section sides 106 is less than six inches and more preferably is about 5.2 inches. Strengthening cross members may be disposed between the inner margins of the two C-section sides 106.

Figure 15:
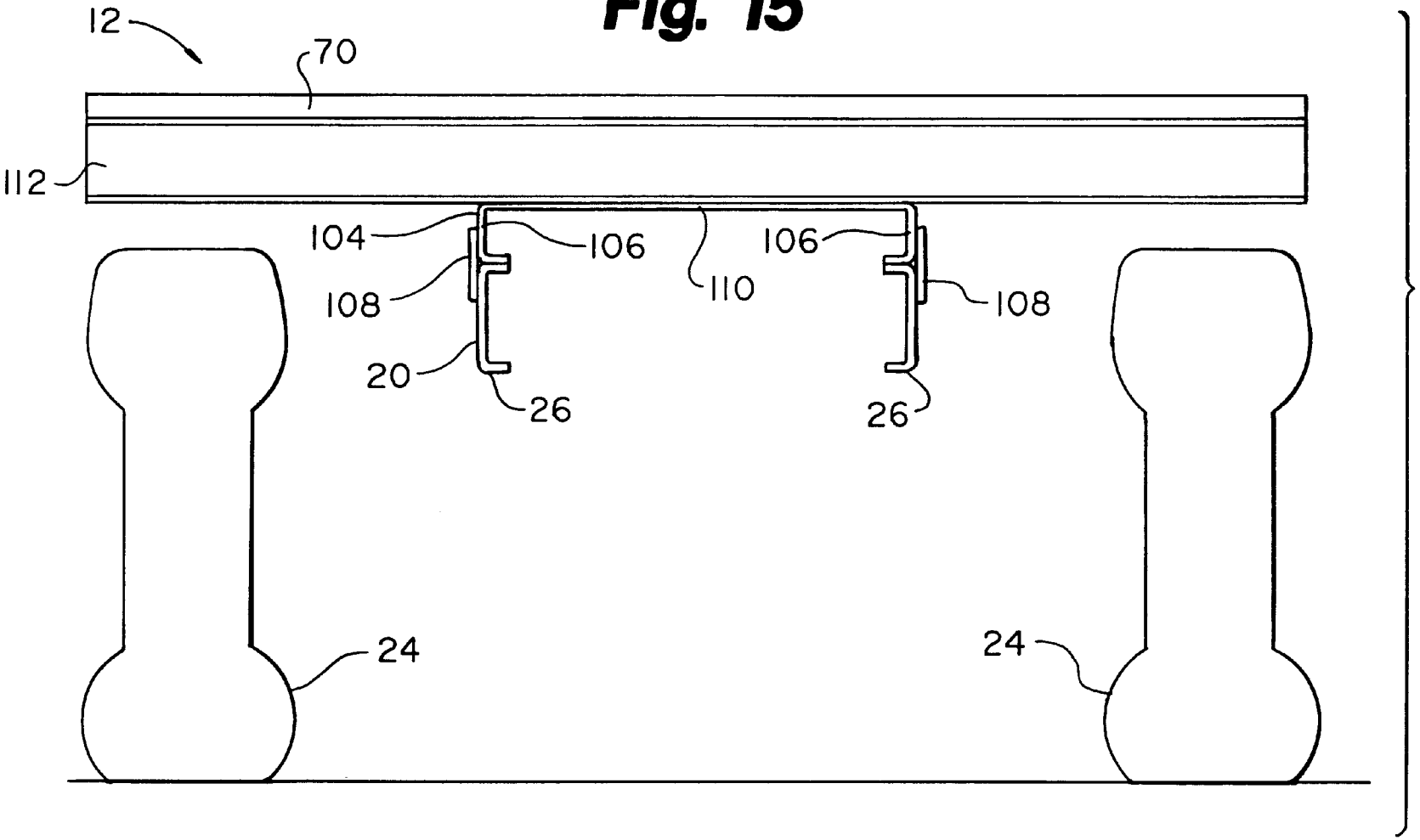
FIG. 15 is an end view of the stationary bed supported on the vehicle chassis.

Since the subrail 104 extends substantially the full length of the bed portion of the vehicle 12, the subrail 104 supports both the stationary bed 70 and the tilt bed 72. The support for the stationary bed 70 is depicted in FIG. 15. The plurality of cross members 112 extend widthwise across the top plate 110 of the subrail 104. The cross members 112 support the stationary bed 70. A depending cylinder bracket 114 may be fixedly coupled to the outer margin of a C-section side 106 and to the outer margin of the underlying portion of the frame 26. The depending cylinder bracket 14 defines a cylinder hinge point 118 for coupling a first end of a cylinder 116 to the depending cylinder bracket 114. A first cylinder hinge pin 120 pivotally couples the cylinder 116 to the depending cylinder bracket 114.

A depending hinge bracket 121 is disposed proximate the rear margin of the subrail 104. A bed hinge point 122 is disposed in the depending hinge bracket 121. A bed hinge pin 124 may be disposed within the bore defining the bed hinge point 122.

The second component of the tilt frame assembly is the tilt frame 126. The tilt frame 126 includes spaced apart elongate rails 128. In a preferred embodiment, the elongate rails 128 may be comprised of box section steel. The lateral dimension between the two spaced rails 128 may be slightly greater than the lateral dimension between the outside margins of the two C-section sides 106.

A depending cylinder bracket 130 may be fixedly coupled to a selected rail 128 proximate the forward margin of the rail 128. The depending cylinder bracket defines a cylinder hinge point 132 by means of a bore defined therein. A second cylinder hinge pin 134 may be disposed in the cylinder hinge point 132 to pivotally couple the second end of the cylinder 116 to the tilt frame 126.

A depending tilt bracket 136 depends from each of the two rails 128. A bore is defined in the depending tilt bracket 136 which defines a bed hinge point 138. The bed hinge point 138 is in registry with the bed hinge point 122 and is pivotally coupled thereto by the bed hinge pin 124.

A tow pintle 140 is disposed proximate the rear margin of the rails 128. The pintle 140 has a pintle lower margin 142. As will be seen, the pintle lower margin 142 comes into contact with the ground surface when the tilt frame 126 is in a tilted disposition to assist in supporting the tilt frame assembly 100, the tilt bed assembly 102 and the howitzer 14 when the howitzer 14 is disposed on the tilt bed assembly 102.

The second major component of the tilt bed 72 is the tilt bed assembly 102. It is important to realize that the tilt bed assembly 102 is translationally, shiftably disposed relative to the tilt frame assembly 100. Accordingly, the tilt bed assembly 102 is tiltable by the tilt frame assembly 102 and may translate rearward/forward relative to the tilt frame assembly 100 to effectively extend the tilt bed 72 rearward for loading the howitzer 14 from a disposition on the ground.

Figure 16:
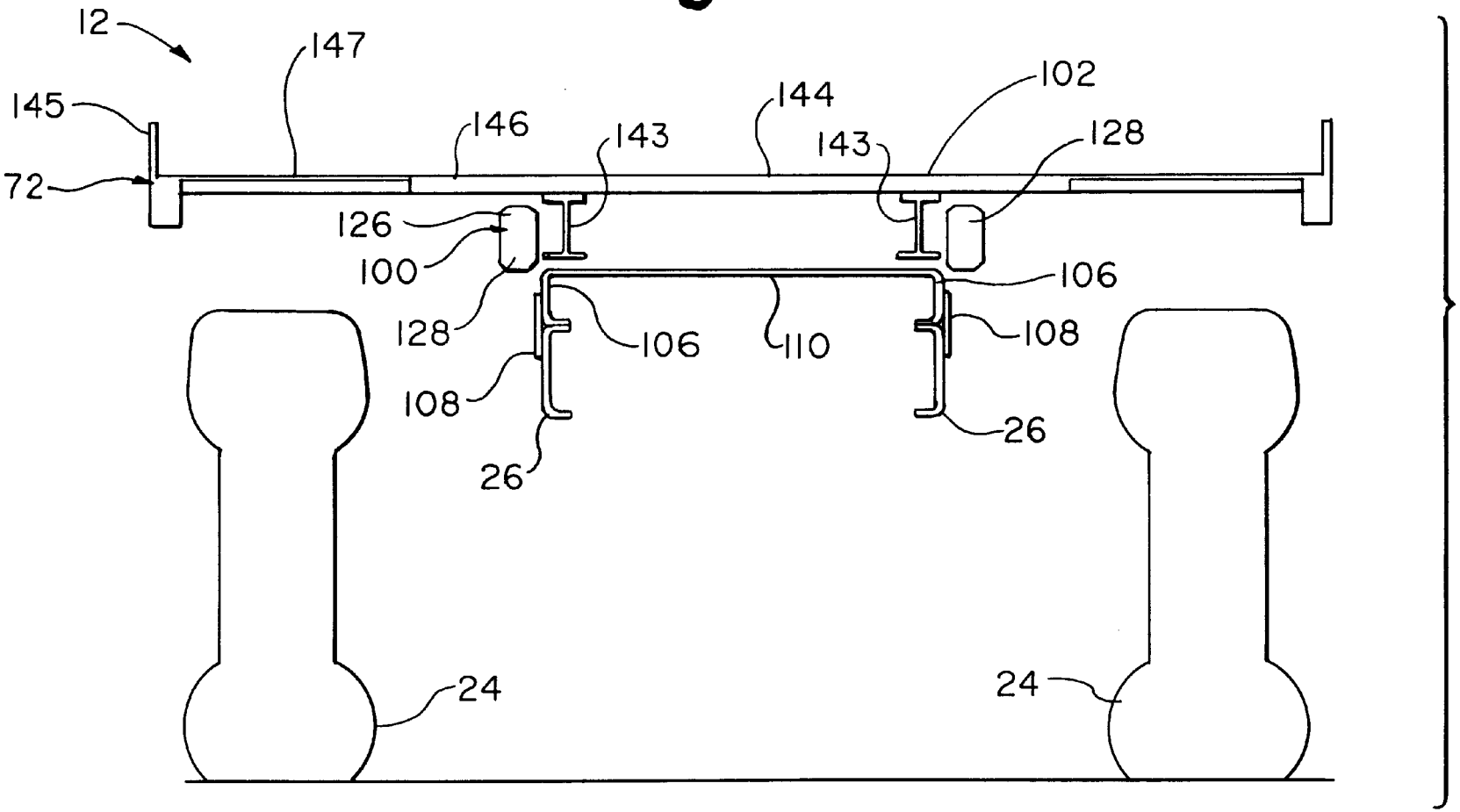
FIG. 16 is an end view of the tilt bed supported on the vehicle chassis.

Referring to FIG. 16, the tilt bed 144 is supported on a pair of spaced apart I beams 143. The I beams 143 extend substantially the full length dimension of the tilt bed assembly 102. The I beams 143 are disposed inward of the elongate rails 128 of the tilt frame 126.

Referring to FIGS. 2 and 16, the tilt bed 144 has upward directed edges 145 on either side of the load surface 146. A wheel relief 147 is preferably defined in the underside of the load surface 146 to accommodate the wheels 24 of the vehicle 12. A base plate receiver 148 is designed in the load surface 146. The base plate receiver 148 is designed to receive and to lock in place the base plate 53 of the howitzer 14.

A powered guide system 150 is disposed on the load surface 146. The powered guide system has components that translate along the longitudinal axis of the tilt bed 144. Such components are preferably hydraulically powered and assist in loading and unloading the howitzer 14 onto the tilt bed 72.

The powered guide system 150 includes a track 152. A guide device 154, depicted in FIG. 1, is designed to ride in the track 152. The guide device 154 is designed to be couplable to a variable height draw bar 156, as depicted in FIG. 1.

The variable height draw bar 156 includes a generally upward directed tube bar 158 that is attachable by a tube coupling 160 to the tube 40 of the howitzer 14. A generally rearward directed cradle bar 162 is attachable by a cradle coupling 164 to the cradle 50 of the howitzer 14.

It is understood that the bars 158, 162 of the variable height draw bar 156 are semi-rigid such that in addition to pulling the howitzer 14 up onto the tilt bed 72, the bars 158, 162 restrain any tilting moment that occurs in the howitzer 14 during transition on the tilt bed 72. Additionally, the bars 158, 162 are comprised of telescoping bar segments 166. The telescoping bar segments 166 permit the semi-rigid length of the bars 158, 162 to be varied in order to hold the howitzer 14 in various longitudinal dispositions on the tilt bed 72 as well as to elevate and depress the tube 40 relative to the tilt bed 72 as desired.

Figure 6A:
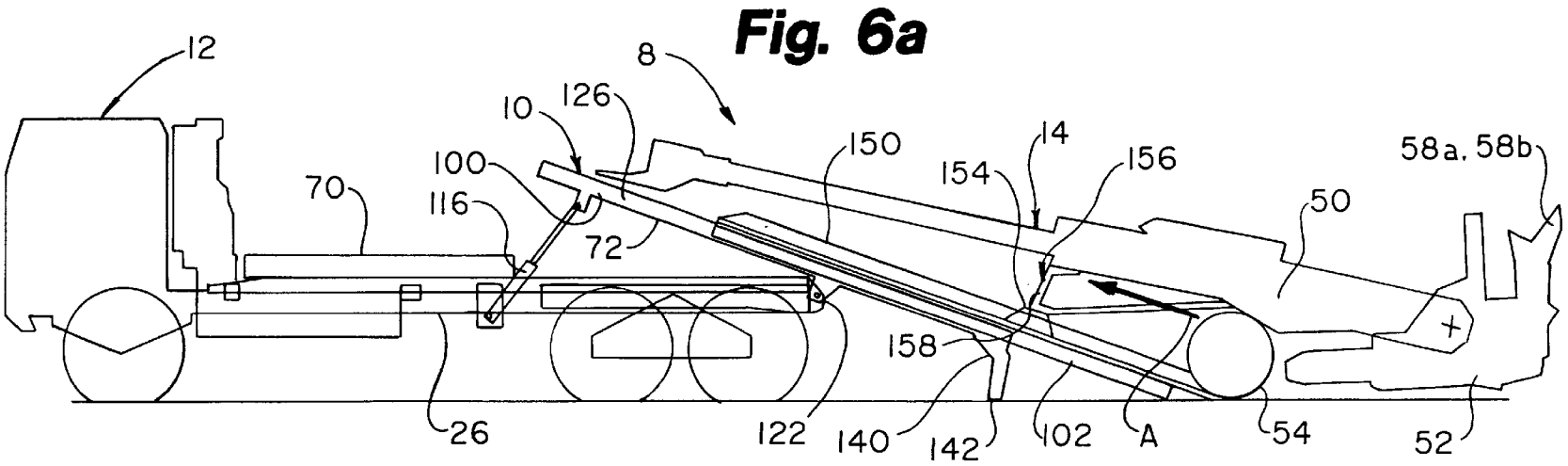
FIGS. 6*a*–6*g* depict a loading sequence taking the howitzer from disposed rearward of the vehicle to the transport disposition on the vehicle.

Loading operations for loading a howitzer 14 onto the vehicle 12 by means of a tilt bed system 10 are depicted in FIGS. 6*a*–6*h*. Referring to FIG. 6*a*, a depiction of the howitzer 14 just starting to move up the tilt bed assembly 102 is provided. Prior to commencing such motion as indicated by the arrow A, the cylinder 116 is extended to tilt the tilt bed 72 relative to the frame 26 of the vehicle 12. The tilt bed 72 is tilted a sufficient amount such that the lower margin 142 of the tow pintle 140 is in contact with the surface upon which the vehicle 12 is resting. The tilt bed assembly 102 is translated rearward relative to the tilt frame assembly 100 until the rear margin of the tilt bed assembly 102 is also in contact with the surface. The guide device 154 is translated rearward in the track 152 of the powered guide system 150. The guide device 154 is operably coupled to the howitzer 14 by means of the variable height draw bar 156. Preferably, the cradle 50 of the howitzer 14 is at a plus 15° angle relative to the undercarriage 52. The suspension of the howitzer 14 is adjusted such that the bottom tangent of the wheel 54 is close to the plane of the undercarriage 52 base. The stabilizers 56*a*, 56*b* are folded back and the trails 58*a*, 58*b* are raised to the transport disposition. As depicted in FIG. 6*a*, the guide device 154 has just started to move the howitzer 14 up the tilt bed assembly 102. It should be noted that the variable height draw bar 156 is counteracting the center of gravity moment of the howitzer 14 to maintain the undercarriage 52 elevated above the surface.

Figure 6B:
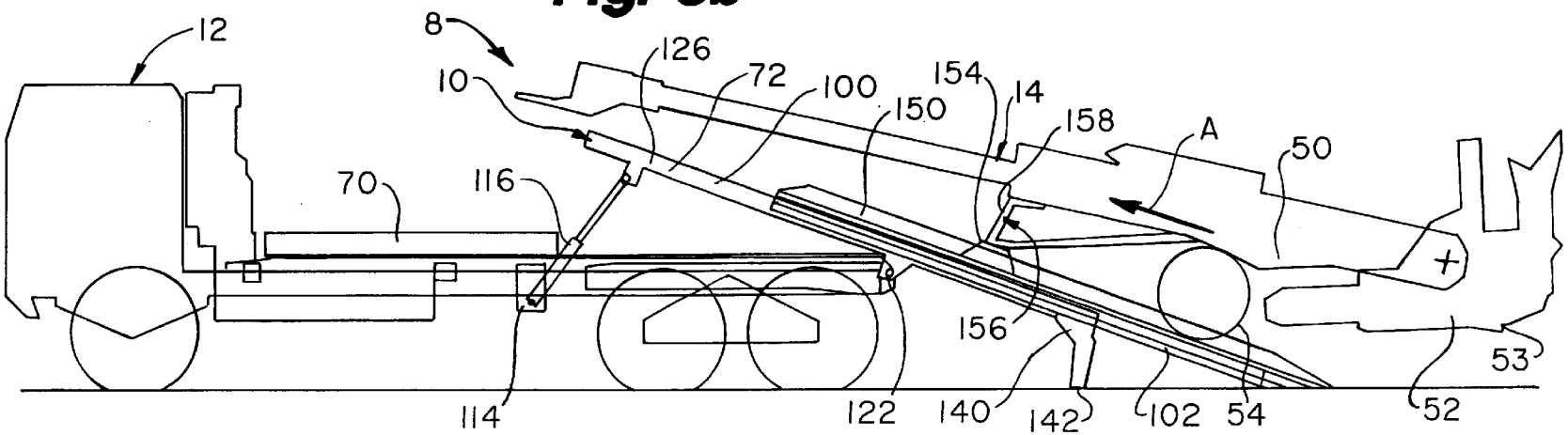

Referring to FIG. 6*b*, the motion depicted by arrow A has drawn the howitzer 14 upward on the tilt bed assembly 102. The depiction of FIG. 6*b* shows the howitzer 14 disposed at an intermediate disposition between the depiction of FIG. 6*a* and that of FIG. 6*c*.

Figure 6C:
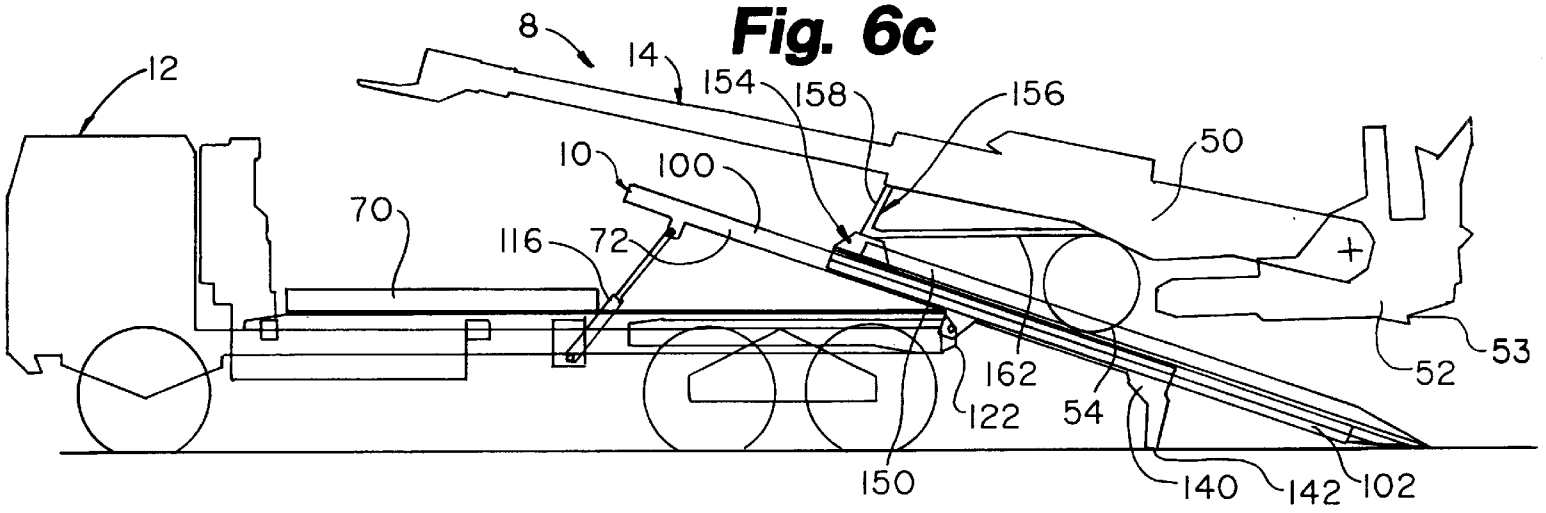

In FIG. 6*c*, upward motion of the howitzer 14 onto the tilt bed assembly 102 has stopped, as indicated. The guide device 154 of the powered guide system 150 has translated to its forwardmost disposition on the tilt bed assembly 102.

Figure 6D:
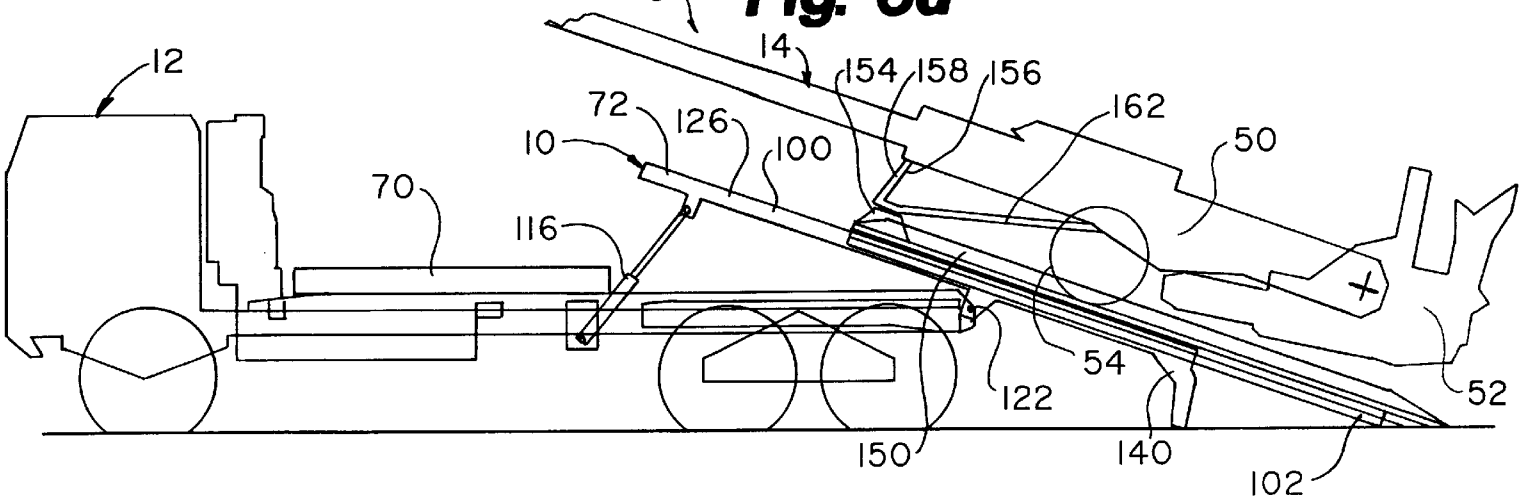

In the depiction of FIG. 6*d*, the howitzer 14 remains at the same disposition on the tilt bed assembly 102 as depicted in FIG. 6*c*. The undercarriage 52 is rotated relative to the cradle 50 of the howitzer 14 such that the cradle 50 is at a +8° angle relative to the undercarriage 52. In such disposition, the lower margin of the undercarriage 52 is not in contact with the load surface 146 of the tilt bed assembly 102.

Figure 6E:
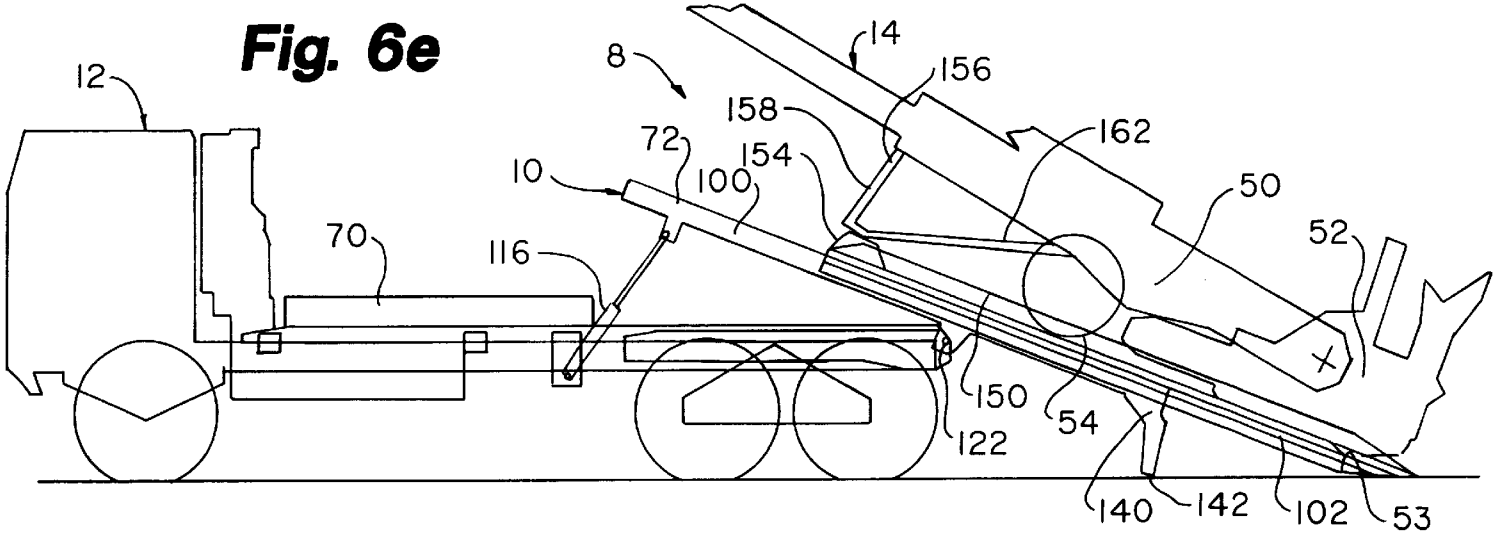

Referring now to FIG. 6*e*, the configuration of the howitzer 14 remains as depicted in FIG. 6*d*. The tube bar 158 of the variable height draw bar 156 is extended, lowering the undercarriage 52 to the load surface 146 of the tilt bed assembly 102. In such disposition, the base plate 53 is engaged with and locked into the base plate receiver 148 disposed on the tilt bed assembly 102.

Figure 6F:
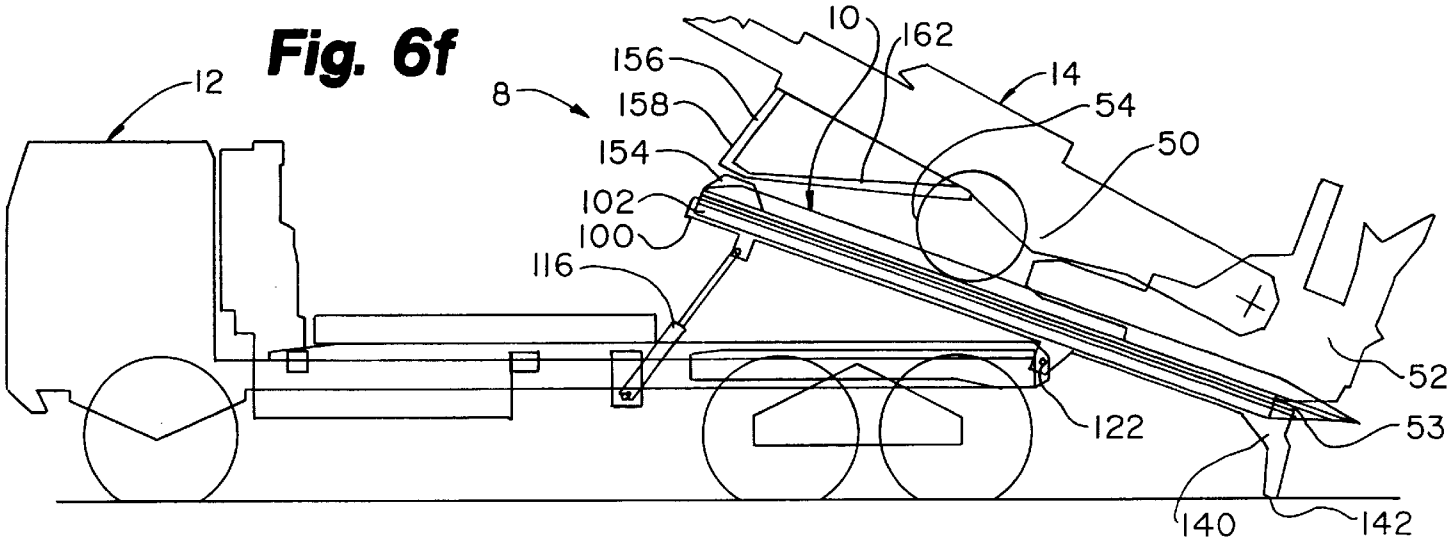

As depicted in FIG. 6*f*, once the howitzer 14 is locked to the tilt bed assembly 102, the tilt bed assembly 102 is translated forward relative to the tilt frame assembly 100 such that the leading edge of the tilt bed assembly 102 is substantially coincident with the leading edge of the tilt frame assembly 100. Such action withdraws the rear margin of the tilt bed assembly 102 from contact with the surface.

Figure 6G:
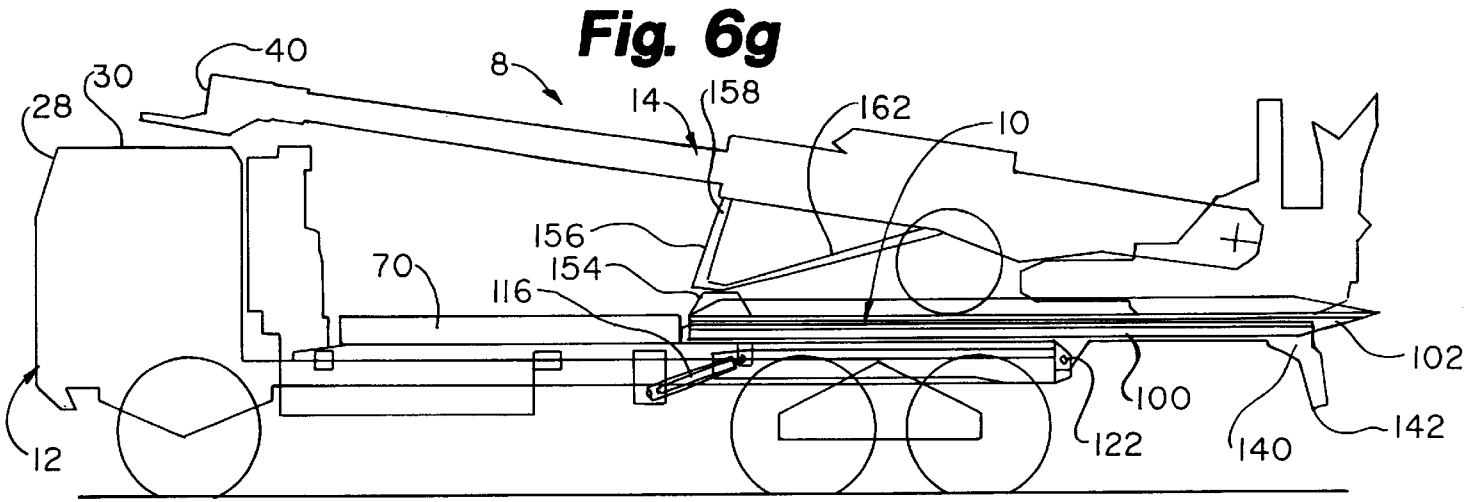

The transport disposition of the howitzer 14 on the vehicle 12 is depicted in FIG. 6*g*. The cylinder 116 is retracted to lower the tilt bed 72 under the subrail 104. The muzzle 44 of the howitzer 14 partially overlies the cab roof 30 of the cab 28.

FIG. 7 depicts the cross sectional dimensions of the cargo bay of the C-130 aircraft. It is the envelope defined by these dimensions into which the cannon system 8 must be disposed for transport of the cannon system 8 by a single C-130 aircraft. A critical dimension of the envelope is the height dimension. In the transport disposition of FIG. 6*g*, the upper margin of the muzzle 40 is the highest element of the cannon system 8. As such, the cannon system 8 is not able to be disposed within the envelope of the cargo bay of the C-130 type aircraft.

Figure 6H:
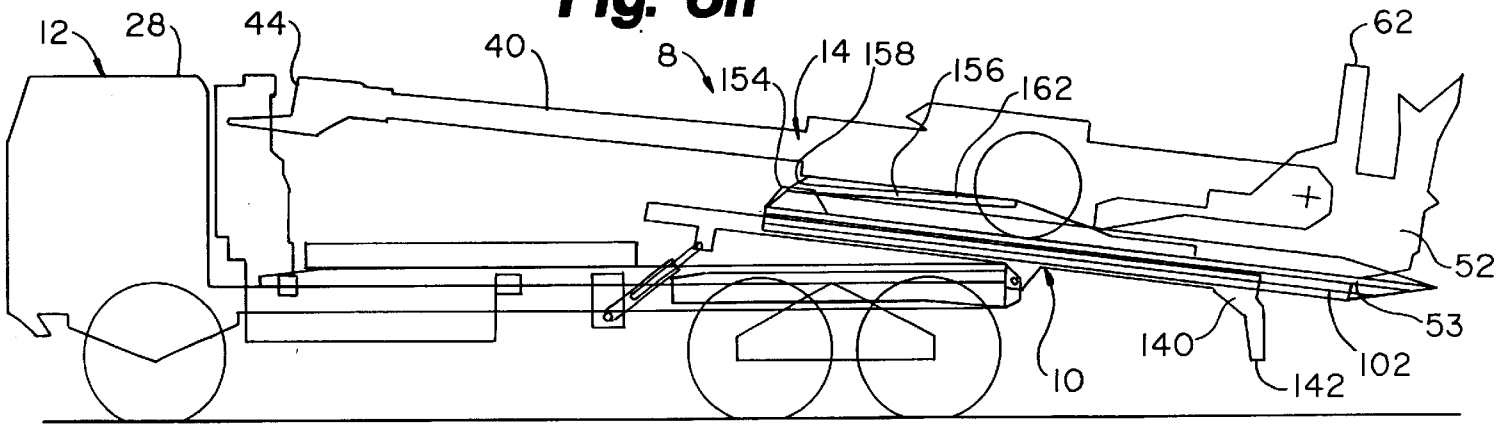
FIG. 6*h* is a side elevational view of the cannon system in the aircraft transport disposition.

Referring now to FIG. 6*h*, the cannon system 8 is depicted in the C-130 transport disposition. In such disposition, the howitzer 14 remains locked to the tilt bed assembly 102 as previously described. The tube bar 158 of the variable height draw bar 156 is retracted to its shortest dimension while the cradle 50 of the howitzer 14 is depressed to −1° relative to the undercarriage 52. In the C-130 transport disposition, the muzzle 40 may not overlie the cab 28. Accordingly, the cylinder 116 is extended somewhat in order to tilt the tilt bed 72 at a preferably 7.5° angle relative to the transport disposition. Additionally, the tilt bed assembly 102 is translated rearward relative to the tilt frame assembly 100 a preferred distance of about 35 inches. In such disposition, the highest component of the howitzer 14 becomes the optical sight mounts 62. It has been shown that in the disposition depicted in FIG. 6*h*, the optical sight mounts 52 have a elevation about the surface upon which the vehicle 12 is resting that is sufficiently low to clear the upper limit of the envelope of the cargo area of the C-130 type aircraft. In order to stabilize the tilt bed 72 in the disposition depicted in FIG. 6*h*, mechanical locks are added to the cylinder 16 to mechanically lock it in place. Further, mechanical locks are added to the tilt bed assembly 102 to lock the tilt bed assembly 102 to the tilt frame assembly 100. Such locks may be as simple as disposing pins in bores brought into registry, the bores being formed in both the tilt bed assembly 102 and the tilt frame assembly 100.

Figure 9:
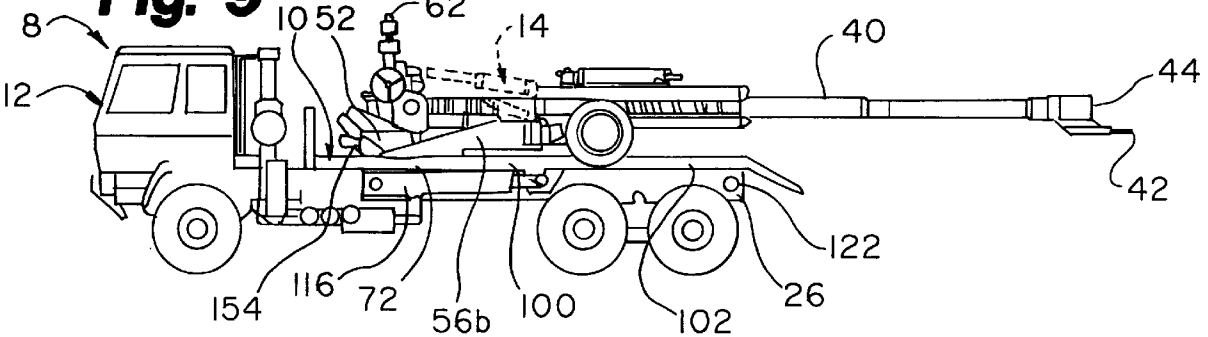
FIG. 9 is a side elevational view of the cargo area of a C-130 aircraft with an alternative embodiment of the cannon system disposed therein.
Figures 8A, 8B:
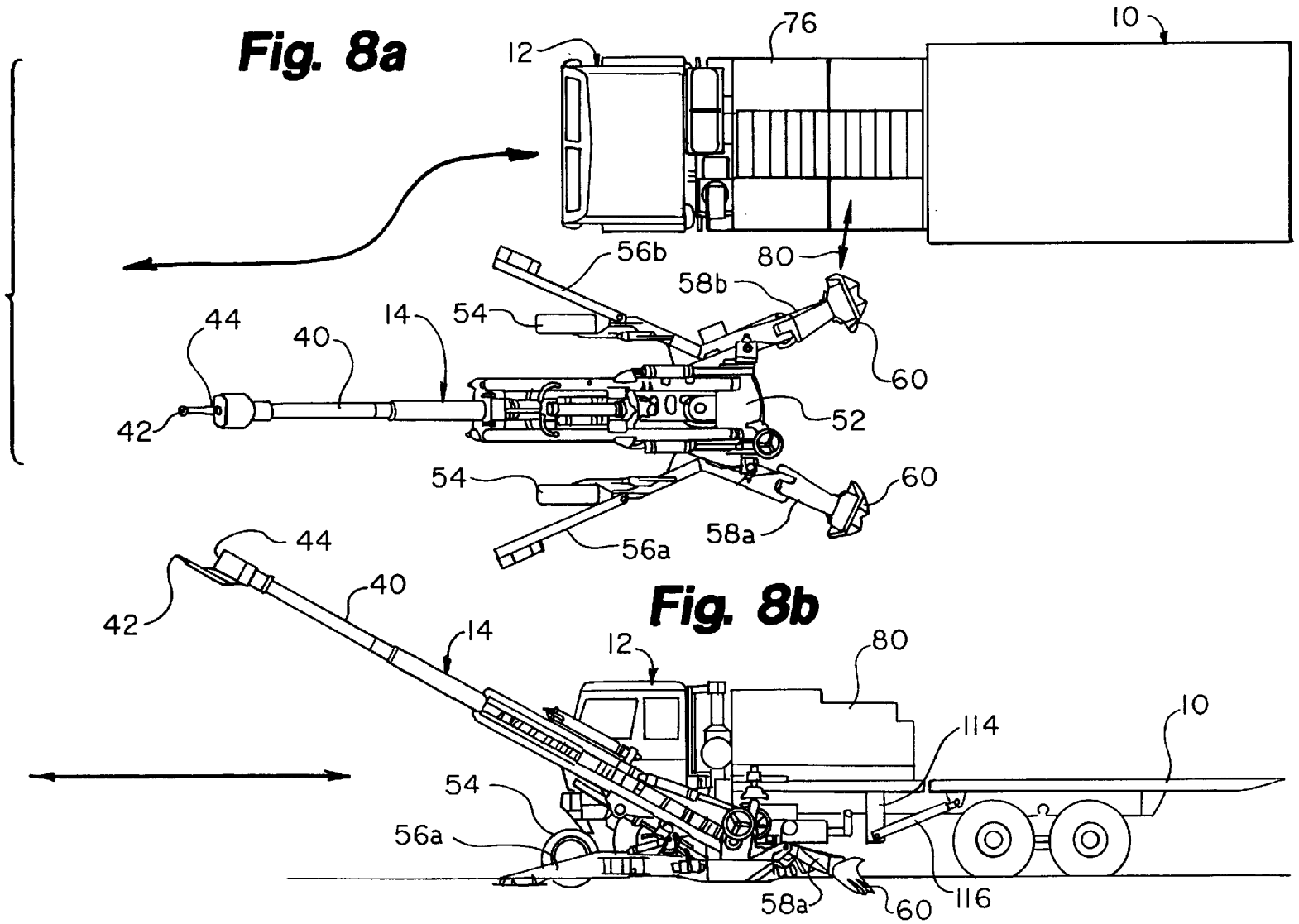
FIG. 8*a* is a top plan form view of the howitzer disposed along side the vehicle in a tactical disposition showing ammunition flow from the vehicle to the howitzer.
FIG. 8*b* is a side elevational view of the cannon system of FIG. 8*a*.

A second embodiment of the present invention is depicted in FIGS. 9–12. The depiction of FIG. 9 shows a relatively short wheelbase vehicle 12. Such vehicle 12 includes a tilt bed 72 but does not include a stationary bed 70 as described with reference to the embodiment above. The tilt bed 72 includes both a tilt frame assembly 100 and a tilt bed assembly 102. The tilt bed 72 is tilted by a cylinder 116 about the bed hinge point 122. The tilt bed assembly 102 translates rearward relative to the tilt frame assembly 100 in order to place the rear margin of the tilt bed assembly 102 in contact with the surface underlying vehicle 12 when the tilt bed 72 is in the tilted disposition.

The tilt bed 72 includes a powered guide system 150. The powered guide system 150 includes a translatable guide device 154 that is movable along a track 152. The guide device 154 includes a first portion of a quick hitch. A second portion of the quick hitch is affixed to the lower rear margin of the undercarriage 52 of the howitzer 14. The guide device 154 is secured to the howitzer 14 by the quick hitch. An advantage of the embodiment of FIG. 9 is that the center gravity moments of the howitzer 14 are accommodated by securely affixing the undercarriage 52 to the guide device 154. Accordingly, no variable height draw bar 156 is needed as described with reference to the embodiment above.

The embodiment of FIGS. 10–14 utilizes a vehicle 12 substantially similar to the vehicle 12 described with reference to the embodiment of FIGS. 1–5. The vehicle 12 has a long wheelbase and includes a fish tail 32. In the embodiment of FIGS. 10–14, the fish tail 32 is utilized in its full length and is not truncated as was indicated with reference to the embodiment of FIGS. 1–5. While not shown, it is clear that an optional two-man crew cab as depicted in FIG. 1 could be incorporated into the embodiment of FIGS. 10–14 by reducing the amount of ammunition carried and shifting the ammunition rearward.

Figure 10:
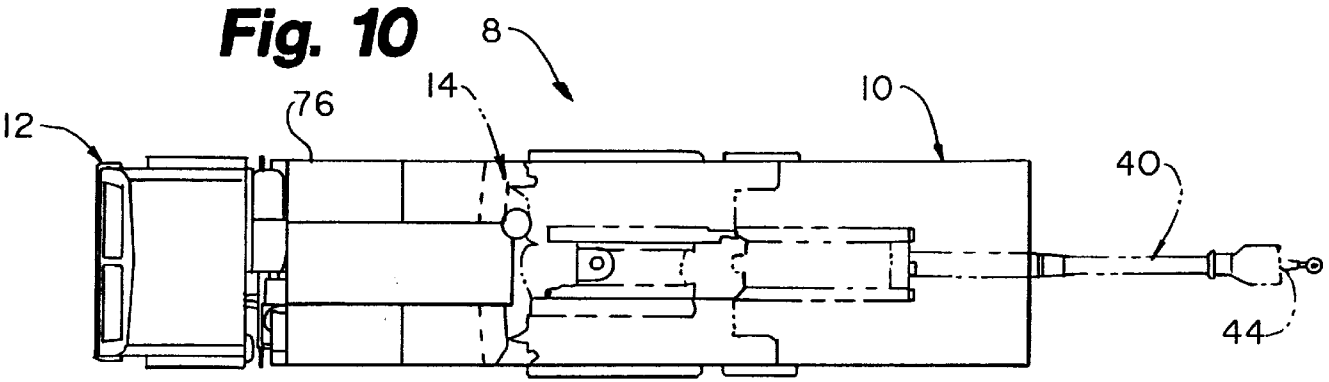
FIG. 10 is a top planform view of the cannon system of the present invention on a long wheelbase vehicle.
Figure 11:
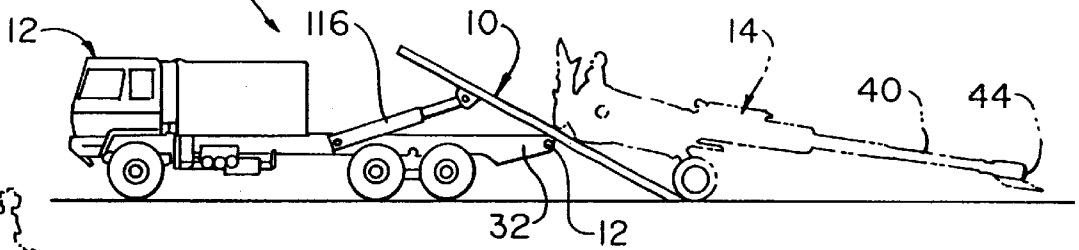
FIG. 11 is a side elevational view depicting the howitzer immediately prior to loading onto the vehicle of FIG. 10.
Figure 12:
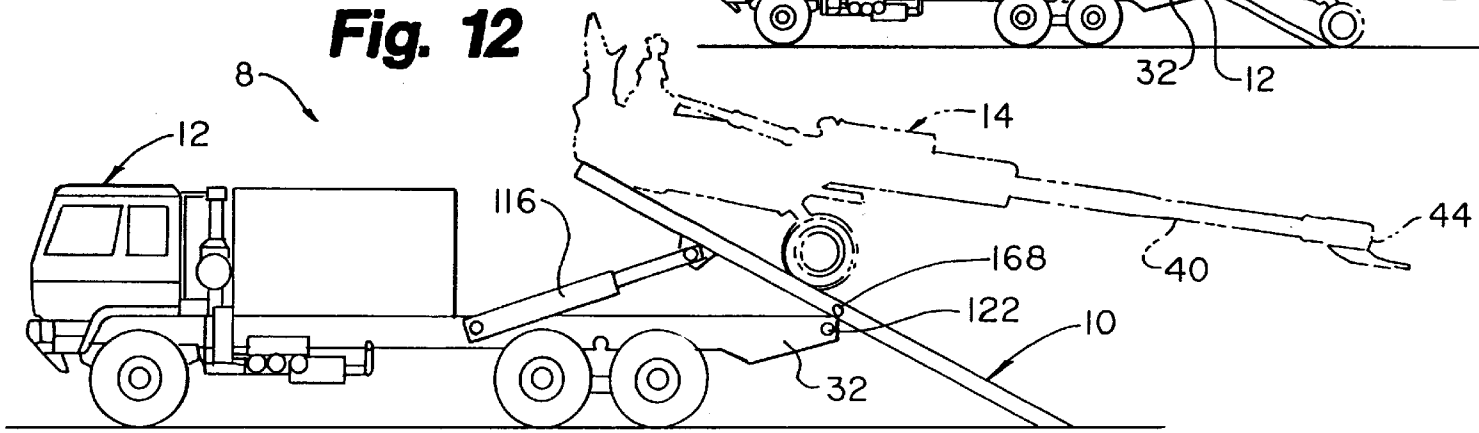
FIG. 12 is a side elevational view of the howitzer loaded onto the tilt bed of the vehicle prior to tilting the tilt bed to a substantially horizontal disposition.

FIG. 10 depicts the cannon system 8 in the transport disposition in which the howitzer is moved on the vehicle 12 to a tactical disposition. FIG. 11 depicts the howitzer 14 just prior to pulling the wheels 54 onto the tilt bed assembly 102. in this embodiment, the guide device 154 is translatable to proximate the rear margin of the tilt bed assembly 102. In such disposition, the guide device 154 is connectable to the howitzer 14 by the quick hitch device, the second portion of which is disposed at the lower rear margin of the undercarriage 52 of the howitzer 14. In the depiction of FIG. 11, the guide device 154 has translated approximately half the distance of the track 152. Turning now to FIG. 12, the guide device 154 is translated virtually to the forward margin of the track 152 at the forward margin of the tilt bed assembly 102.

Figure 13:
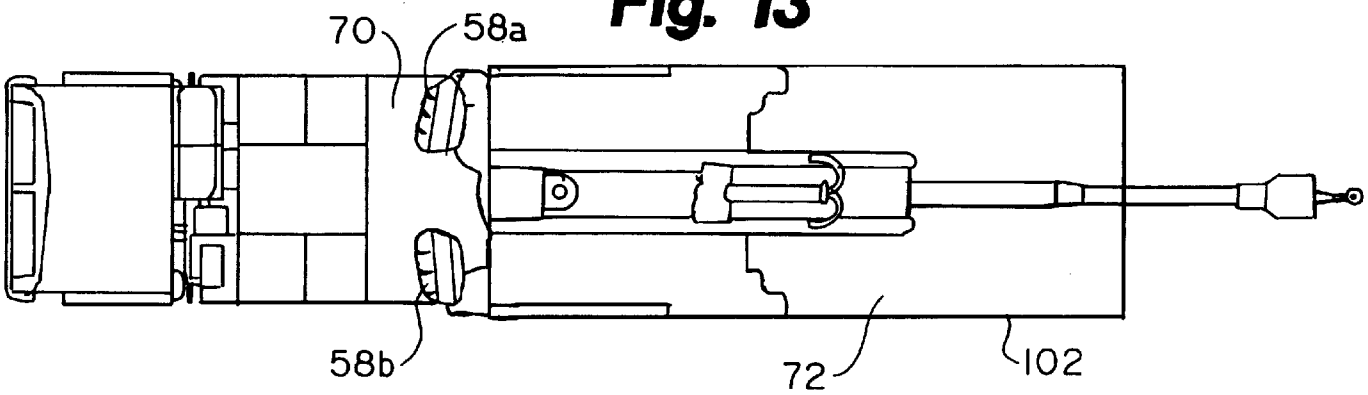
FIG. 13 is a top planform view of the cannon system in the aircraft transport disposition.
Figure 13A:
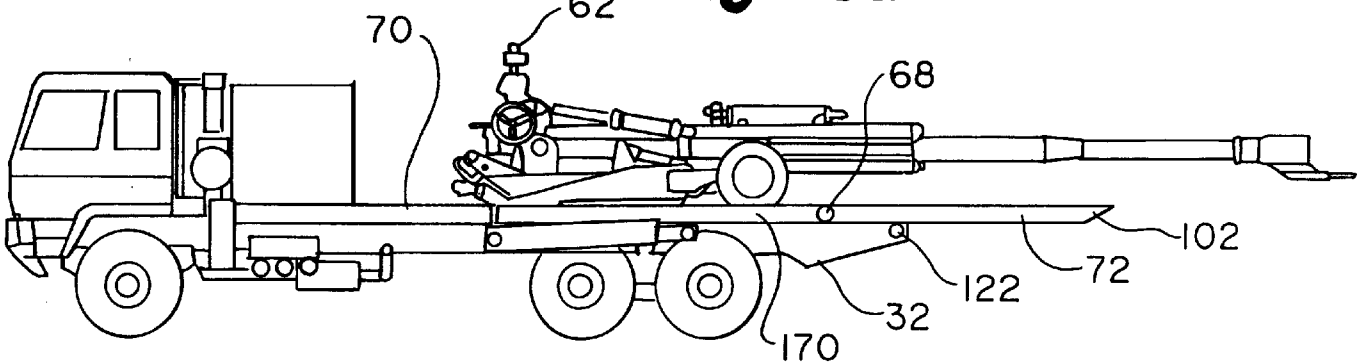
FIG. 13*a* is a side elevation view of the cannon system in the aircraft transport disposition.
Figure 14:
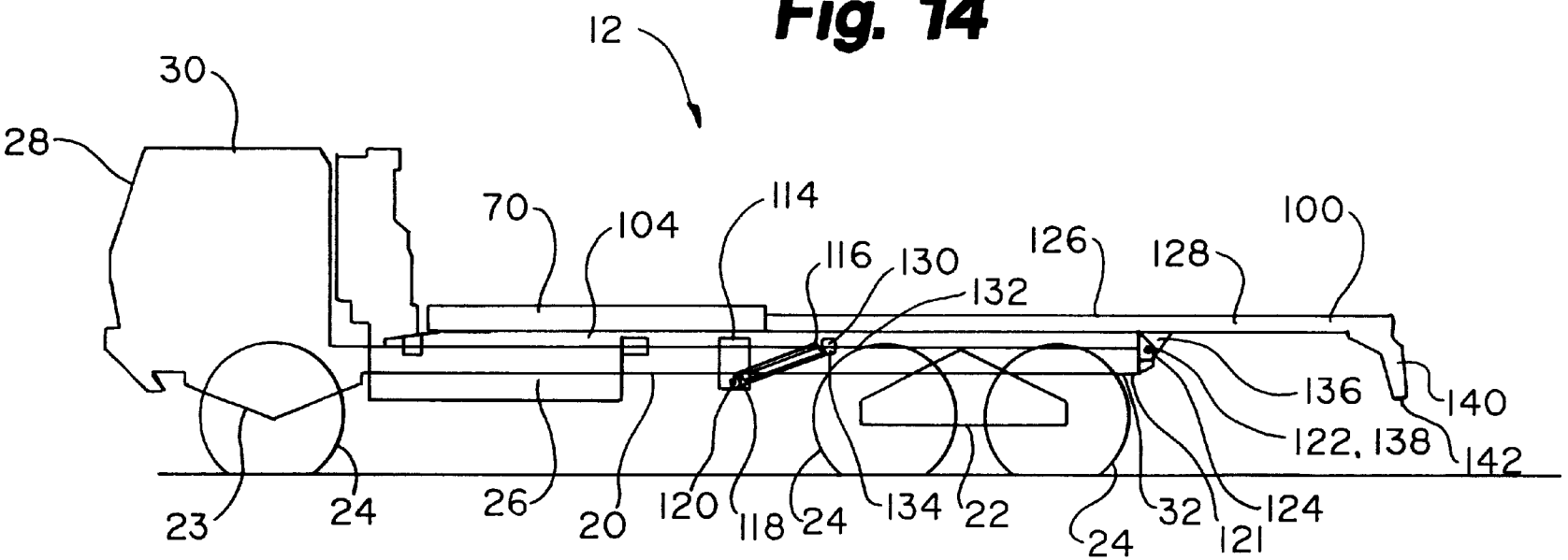
FIG. 14 is a side elevational view of the vehicle without the tilt bed assembly.

FIGS. 13 and 14 depict the cannon system 8 in the C-130 transportable disposition. It should be noted in comparing FIGS. 12 and 14 that the point on the tilt bed assembly 102 about which the tilt bed assembly 102 pivots moves rearward from the down and locked disposition of FIG. 14 to the raised, tilted disposition of FIG. 12. Note the mark 168 in FIG. 14. This mark 168 moves rearward to a disposition immediately above the bed hinge point 122 in FIG. 12. The tilt bed assembly 102 is drawn downward from the disposition of FIG. 12 to the disposition of FIG. 14 it is also drawn forward such that the forward margin of the tilt bed assembly 102 is proximate the rear margin of the stationary bed 70.

The depictions of FIGS. 13 and 14 depict the cannon system 8 in the C-130 transportable disposition. It should be noted that the extendible trails 58*a*, 58*b* depicted in FIG. 13, are not depicted in FIG. 14. In order to meet the envelope requirements of the cargo area of the C-130 type aircraft, the howitzer 14 is drawn forward on the tilt bed assembly 102 such that a significant portion of the howitzer 14 overlies the stationary bed 70. Further, the cradle 50 is at substantially 0° elevation with respect to the undercarriage 52 of the howitzer 14. When the howitzer 14 is drawn forward, the extendible wheels 54 of the howitzer 14 reside within wheel cutouts 170 defined in the load surface 146 of the tilt bed assembly 102. The underside of the carriage 52 is resting on the load surface 146. It will be noted in this disposition that the optical sight mounts 62 are the highest point of the cannon system 8. In order to accommodate this elevation within the cargo envelope of the C-130 aircraft, the suspension 22, 23 of the vehicle 12 is compressed and a certain amount of air is let out of the wheels 24. Such action reduces the overall height of the cannon system 8 by approximately seven inches thereby allowing the cannon system 8 to fit within the envelope of the cargo area of a C-130 type aircraft.

It will be obvious to those skilled in the art that other embodiments in addition to the ones described herein are indicated to be within the scope and breadth of the present application. Accordingly, the applicant intends to be limited only by the claims appended hereto.

What is claimed is:

1. A high-mobility air-transportable artillery cannon system comprising:

a field howitzer including an undercarriage and a cradle/barrel operably coupled to the undercarriage, the cradle/barrel being selectively elevatably positionable relative to the undercarriage;

a tactical vehicle; and a bed disposable on the vehicle for receiving and supporting the howitzer, the bed including a stationary portion and a tiltable portion, the tiltable portion being selectively tiltably positionable for loading and unloading the howitzer from the vehicle;

wherein the weight of the system is less than the cargo transport weight capacity of a C-130 transport aircraft;

wherein the cradle/barrel of the howitzer and the tiltable portion of the bed are cooperatively positionable in a C-130 transport configuration with the howitzer supported on the bed so that the system is receivable within the cargo bay of the C-130 transport aircraft, whereby the system is transportable with the C-130 aircraft in a single sortie; and wherein the bed includes a deployable pintle hitch for towing a selected one of a plurality of vehicles.

2. The high-mobility artillery cannon system of claim 1 wherein the bed stationary portion includes accommodations for the storing of ammunition suitable for use with the howitzer.

3. The high-mobility artillery cannon system of claim 1 wherein the bed stationary portion includes accommodations for the seating of a plurality of howitzer crewmen.

4. The high-mobility artillery cannon system of claim 1 wherein the bed includes a drop down stabilizer, the stabilizer being selectively deployable in a ground engaging mode for providing stability to the vehicle during operations for loading and unloading of the howitzer on the bed.

5. The high-mobility artillery cannon system of claim 4, wherein the bed drop down stabilizer is extendable when in the ground engaging mode, such extension affecting the height of the bed relative to the ground.

6. The high-mobility artillery cannon system of claim 1 wherein the tiltable bed portion includes a quick hitch, the quick hitch being selectively engageable with a howitzer base plate.

7. The high-mobility artillery cannon system of claim 6, further comprising a track on the tiltable bed portion, and wherein the quick hitch is translatably disposed on the track.

8. The high-mobility artillery cannon system of claim 6 wherein the tiltable bed portion quick hitch engages the howitzer base plate in a manner such that a howitzer grouser blade is supported spaced apart from the tiltable bed portion.

9. The high-mobility artillery cannon system of claim 6 wherein the tiltable bed portion quick hitch comprises a forward howitzer attachment point to the tiltable bed portion when the howitzer is in a transport disposition on the tiltable bed portion.

10. The high-mobility artillery cannon system of claim 1 wherein the tiltable bed portion includes means for securing the howitzer to the bed.

11. The high-mobility artillery cannon system of claim 1 wherein the tiltable bed portion includes a pair of wheel wells, each of the wheel wells defining a depression below a bed surface, the pair of wheel wells being engageable with a pair of howitzer wheels.

12. The high-mobility artillery cannon system of claim 11 wherein the pair of wheel wells act to minimize the height of the howitzer relative to the tiltable bed portion when the howitzer in a transport disposition on the tiltable bed.

13. The high-mobility artillery cannon system of claim 1 wherein the tiltable bed portion includes a cradle/barrel support that is tiltable from a recessed disposition to an engaged disposition, the cradle/barrel support being engageable with the howitzer cradle/barrel for support thereof.

14. The high-mobility artillery cannon system of claim 1 wherein the tiltable bed portion includes a gravity operated conveyor disposable on the tiltable bed portion, the conveyor for facilitating the transfer of objects down the tiltable bed portion when the tiltable bed portion is in a declining unload disposition.

15. The high-mobility artillery cannon system of claim 14 wherein the gravity operated conveyor is disposable in part on the stationary bed portion for effecting the transfer of objects stored on the stationary bed portion directly to a ground surface.

16. A method of configuring a cannon system for transport in a C-130 transport aircraft comprising:

providing a field howitzer, the howitzer including an undercarriage and a cradle/barrel operably coupled to the undercarriage, the cradle/barrel being selectively elevatably positionable relative to the undercarriage;

disposing a bed on a tactical vehicle, the bed including a stationary portion and a tilt portion, the tilt portion being selectively tiltably positionable for loading and unloading the howitzer from the vehicle;

loading the howitzer on the bed;

positioning the cradle/barrel of the howitzer and the tilt portion of the bed so that the system is receivable in a cargo bay of the C-130 aircraft; and disposing a tube muzzle facing forward on the vehicle.

17. The method of claim 16 including translating the tilt bed rearward and declining the tilt bed rearward for disposing the cannon system in the C-130 aircraft.

18. The method of claim 17 including restraining the pitching moment of the howitzer.

19. The method of claim 18 including powering the loading/unloading of the howitzer on the tilt bed.

* * * * *

UNITED STATES PATENT AND TRADEMARK OFFICE

CERTIFICATE OF CORRECTION

PATENT NO. : 6,742,435 B2
DATED : June 1, 2004
INVENTOR(S) : Staiert et al.

It is certified that error appears in the above-identified patent and that said Letters Patent is hereby corrected as shown below:

Column 3,
Line 45, after ";" delete "and".

Column 7,
Line 9, delete "moment" and insert -- movement --.
Line 33, delete "plus" and insert -- + --.

Column 8,
Line 34, after "100" insert -- , --.

Column 9,
Line 4, delete "moments" and insert -- movements --.
Line 24, delete "in" and insert -- In --.
Line 42, delete "14 it" and insert -- 14. It --.
Line 65, after "inches" insert -- , --.

Signed and Sealed this

Nineteenth Day of April, 2005

JON W. DUDAS
*Director of the United States Patent and Trademark Office*